US012767305B2

(12) United States Patent
Nakamori et al.

(10) Patent No.: US 12,767,305 B2
(45) Date of Patent: Oct. 20, 2026

(54) OUTBOARD MOTOR

(71) Applicant: HONDA MOTOR CO., LTD., Tokyo (JP)

(72) Inventors: Kota Nakamori, Saitama (JP); Kazuo Miyamoto, Saitama (JP); Kohei Sasaki, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 484 days.

(21) Appl. No.: 18/468,818

(22) Filed: Sep. 18, 2023

(65) Prior Publication Data

US 2025/0091704 A1 Mar. 20, 2025

(51) Int. Cl.
*B63H 20/32* (2006.01)

(52) U.S. Cl.
CPC ..... *B63H 20/32* (2013.01)

(58) Field of Classification Search
CPC ..... B63H 20/00; B63H 20/32; B63H 20/34; B63H 2020/323
USPC ..... 440/76, 77
See application file for complete search history.

(56) References Cited

U.S. PATENT DOCUMENTS

| | | | | |
|---|---|---|---|---|
| 7,267,592 | B1 * | 9/2007 | Ingebritson | B63H 20/32 123/195 P |
| D629,015 | S * | 12/2010 | Iekura | D15/4 |
| D663,745 | S * | 7/2012 | Isono | D15/4 |
| 9,643,702 | B2 | 5/2017 | Shomura et al. | |
| 10,640,189 | B2 | 5/2020 | Hasegawa | |
| D1,042,541 | S * | 9/2024 | Kabayama | D15/4 |

FOREIGN PATENT DOCUMENTS

| | | |
|---|---|---|
| JP | 2015000676 A | 1/2015 |
| JP | 2019010992 A | 1/2019 |

* cited by examiner

*Primary Examiner* — Daniel V Venne
(74) *Attorney, Agent, or Firm* — Armstrong Teasdale LLP

(57) ABSTRACT

An outboard motor, comprising: a lower case (12) having an open top end and covering a main frame (3) that supports a power source (2) and a vertically extending drive shaft (4) for transmitting a power output of the power source; a bottom frame (17) a rotatable propeller (18), and a gear mechanism (5) for transmitting the power output from a lower end of the drive shaft to the propeller; and an upper case (13) attached to the open top end of the lower case in a detachable manner, wherein the upper case is provided with a top recess (21) provided in a top surface part of the upper case, and a pair of side recesses (26) provided on either side of the upper case, the top recess at least partly overlapping with the side recesses along a fore and aft direction in normal operation.

19 Claims, 10 Drawing Sheets

OUTBOARD MOTOR

TECHNICAL FIELD

The present invention relates to an outboard motor for watercraft, and in particular to an outboard motor having an upper case that can be removed in a convenient manner.

BACKGROUND ART

In recent years, active efforts have been made to provide access to sustainable transportation systems for vulnerable traffic participants such as senior citizens and children. As a part of such efforts, research efforts have been directed to the improvement of traffic safety and convenience through improvement in the operability of watercraft.

An outboard motor is typically provided with an upper case that can be removed from the main body of the outboard motor for servicing and maintenance purposes. JP2015-000676A and JP2019-010992A disclose outboard motors that have a removable upper case which has various openings. However, no provision is made for allowing a user to grip or otherwise hold a part of the upper case when removing the upper case from the main body of the outboard motor.

When the outboard motor is relatively small, the upper case may be removed without much effort even when no grip or handle is provided on the upper case. However, as the size of the outboard motor increases, the weight and the size of the upper case increase to such an extent that the user will find it difficult to grip the upper case and remove it from the main body of the outboard motor.

SUMMARY OF THE INVENTION

In view of such a problem of the prior art, a primary object of the present invention is to provide an outboard motor having an upper case which is configured to be easily removed from the main body of the outboard motor.

To accomplish such an object, the present invention provides an outboard motor, comprising: a lower case (12) having an open top end and covering a main frame (3) that supports a power source (2) and a vertically extending drive shaft (4) for transmitting a power output of the power source; a bottom frame (17) supporting a rotatable propeller (18), and a gear mechanism (5) for transmitting the power output from a lower end of the drive shaft to the propeller; and an upper case (13) attached to the open top end of the lower case in a detachable manner, wherein the upper case is provided with a top recess (21) provided in a top surface part of the upper case, and a pair of side recesses (26) provided on either side of the upper case, the top recess at least partly overlapping with the side recesses with respect to a fore and aft direction in normal operation.

When grabbing the upper case by the recesses, since both hands of the user are extended in a similar fashion owing to the positioning of the top recess and the side recesses, a relatively little effort is required for the user to remove the upper case.

In this outboard motor, preferably, a central point of each side recess along the fore and aft direction overlaps with the top recess with respect to the fore and aft direction.

Thereby, the handling of the upper case is facilitated.

In this outboard motor, preferably, the recesses are positioned at a substantially middle part of the upper case with respect to the fore and aft direction.

Thereby, the handling of the upper case is particularly facilitated.

In this outboard motor, preferably, each of the recesses is provided with a downwardly facing wall surface (24, 27A).

Thereby, a favorable grip can be achieved when grabbing the upper case 13.

In this outboard motor, preferably, each side recess is substantially rectangular in side view, and is defined by an upper wall (27), a front wall (29), a rear wall (30) and a lower wall (28), at least one of the front wall and the rear wall being at an angle to a vertical direction so that the upper wall is longer than the lower wall with respect to the fore and aft direction.

Thereby, the user can put his or her hands comfortably into the recess.

In this outboard motor, preferably, the front wall and the rear wall each form an obtuse angle relative to the lower wall in side view.

Thereby, the user can put his or her hands into the recess in a particularly comfortable manner.

In this outboard motor, preferably, each side recess is configured to get narrower toward an inner part thereof.

Thereby, the user can put his or her hands into the recess in a particularly comfortable manner.

In this outboard motor, preferably, the lower wall is slanted downward toward an outer part thereof.

Thereby, rainwater and water splash can readily run off from the upper surface of the lower wall.

In this outboard motor, preferably, each side recess is closed by an inner wall (31).

Thereby, rainwater and water splash are prevented from entering the upper case from the side recesses.

In this outboard motor, preferably, the top recess is defined by a slanted wall (22) that has a certain lateral width substantially smaller than an overall width of the upper case and slants downward away from a general outer profile of the upper case toward a front part thereof and a pair of triangular side walls (23) extending vertically along either side edge of the slanted wall so as to define a rectangular opening (25) facing rearward.

Since the slanted wall provides a guide for the hand that grips the opposing edge created above the rectangular opening, the user is enabled to grip the opposing edge both firmly and comfortably. The presence of the triangular side walls ensures an adequate mechanical strength of the opposing edge and the slanted wall.

In this outboard motor, preferably, the rectangular opening communicates with an interior of the upper case.

Thereby, rainwater and water splash are prevented from being deposited in the top recess. The rectangular opening provides an air ventilation for the interior of the upper case.

In this outboard motor, preferably, the upper case comprises a pair of side parts (14) jointly forming a cylindrical shell defining open top and bottom ends, and a top part (13) attached to the open top end of the cylindrical shell formed by the side parts, and the top recess is formed in the top part while the side recesses are formed in the side parts, respectively.

Thereby, the manufacturing of the upper case can be simplified in spite of a large size and complex shape thereof.

In this outboard motor, preferably, the side recesses are positioned adjacent to upper edges of the side parts, respectively.

Thereby, reinforcement of the parts of the upper case adjacent to the side recesses is facilitated.

In this outboard motor, preferably, the lower case is provided with a latch handle (19) for selectively latching the upper case to the lower case.

Thereby, the lower case is prevented from being inadvertently dislodged, but can be readily removed from the lower case when desired.

In this outboard motor, preferably, the outboard motor is configured to be selectively tilted up, and the top recess and the side recesses are positioned so as to overlap with each other with respect to the fore and aft direction.

The favorable positioning of the recesses allows the upper case to be removed with ease not only in the normal state of the outboard motor but also in the tilted-up state of the outboard motor.

The present invention thus provides an outboard motor having an upper case which is configured to be easily removed from the main body of the outboard motor.

BRIEF DESCRIPTION OF THE DRAWINGS

Now the present invention is described in the following with reference to the appended drawings, in which.

DETAILED DESCRIPTION OF THE PREFERRED EMBODIMENT(S)

Figure 1:
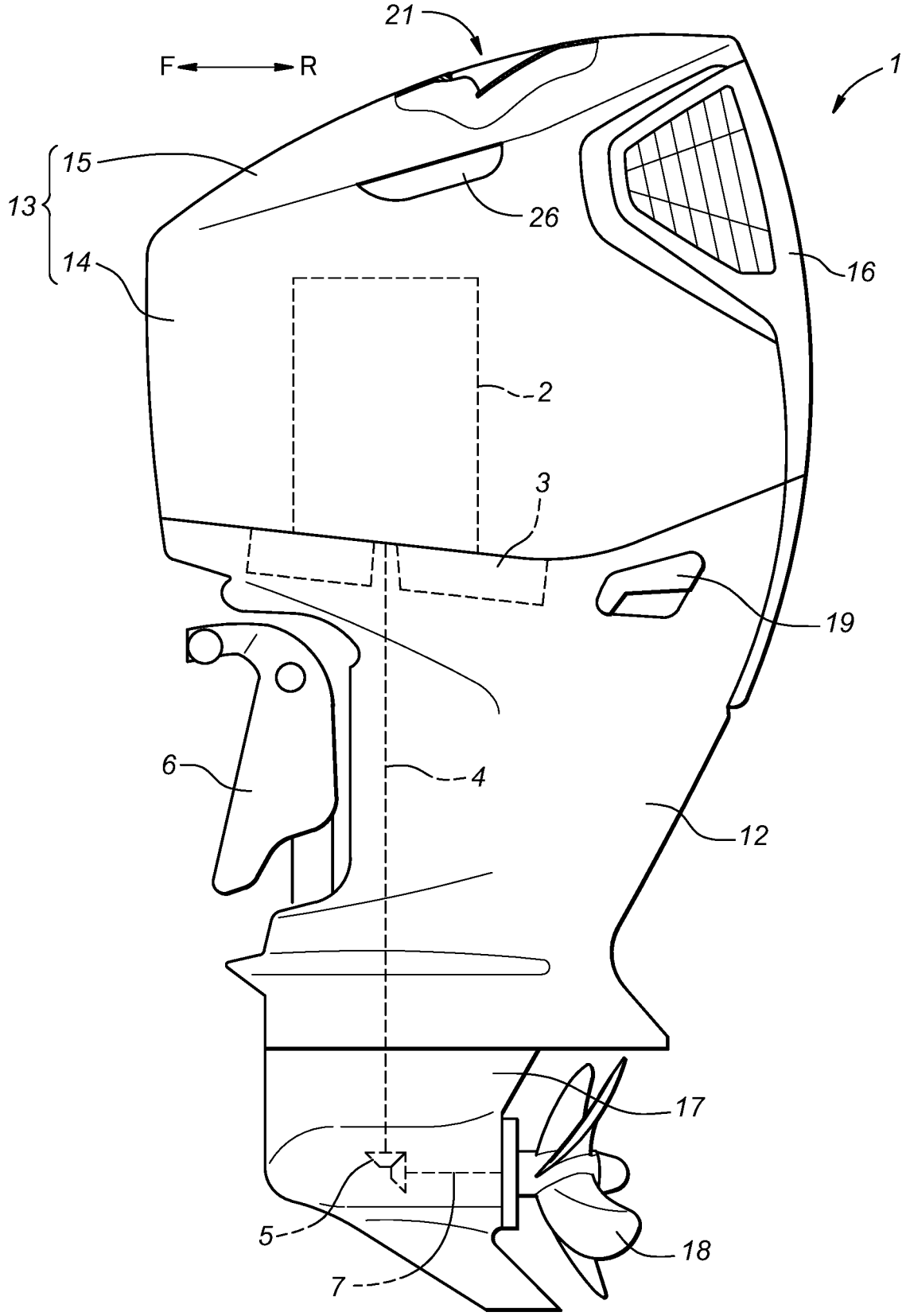
FIG. 1 is a side view of an outboard motor according to an embodiment of the present invention.
Figure 2:
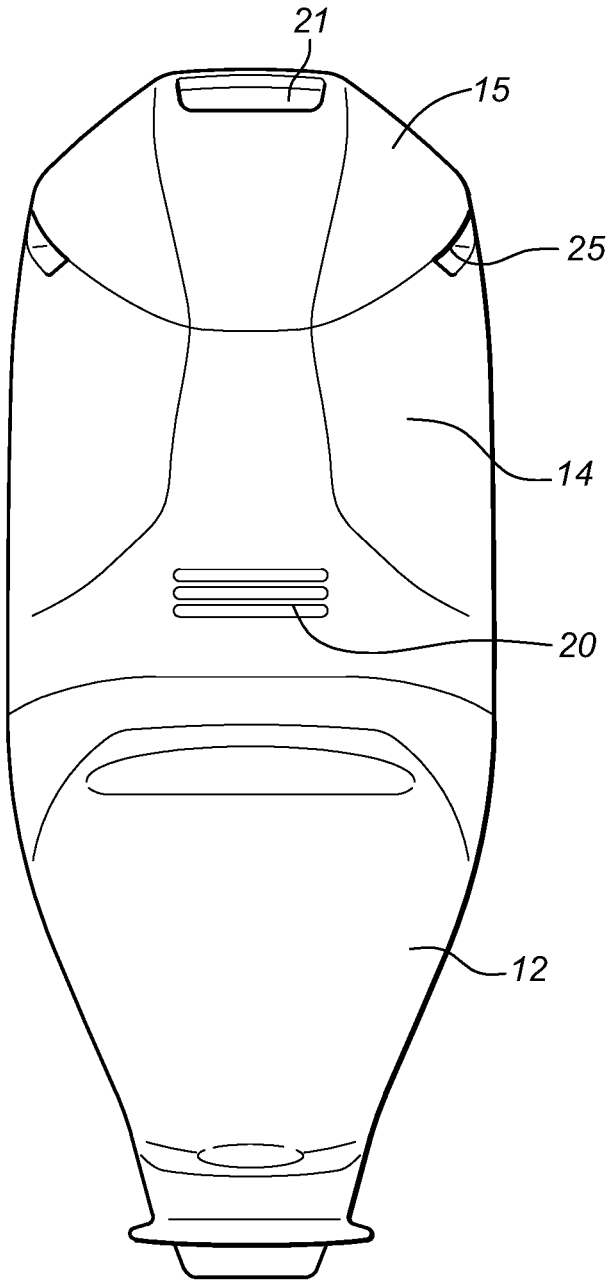
FIG. 2 is a front view of the outboard motor.
Figure 3:
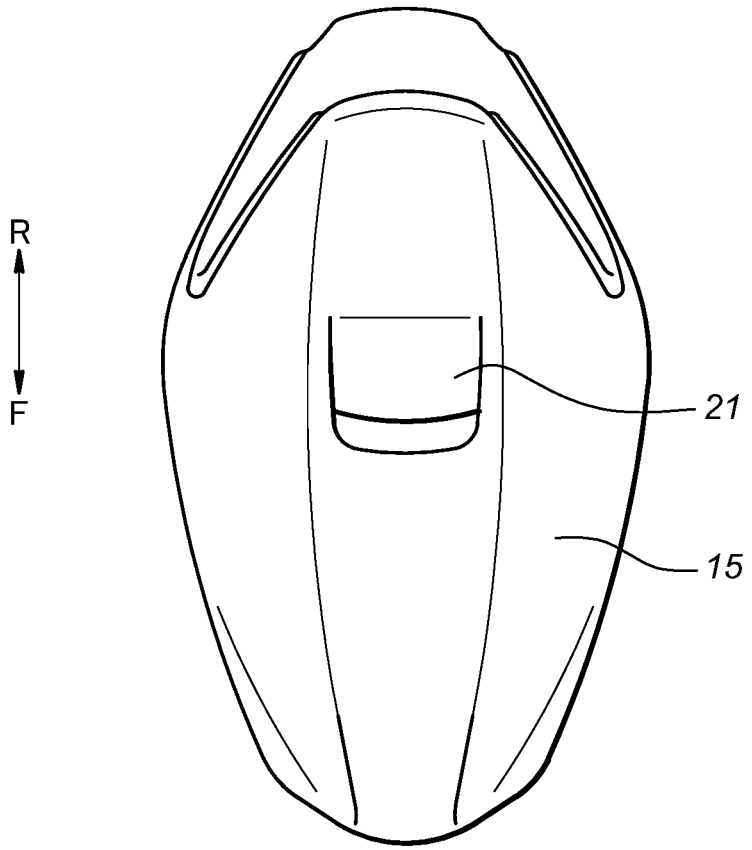
FIG. 3 is a top view of the outboard motor.
Figure 4:
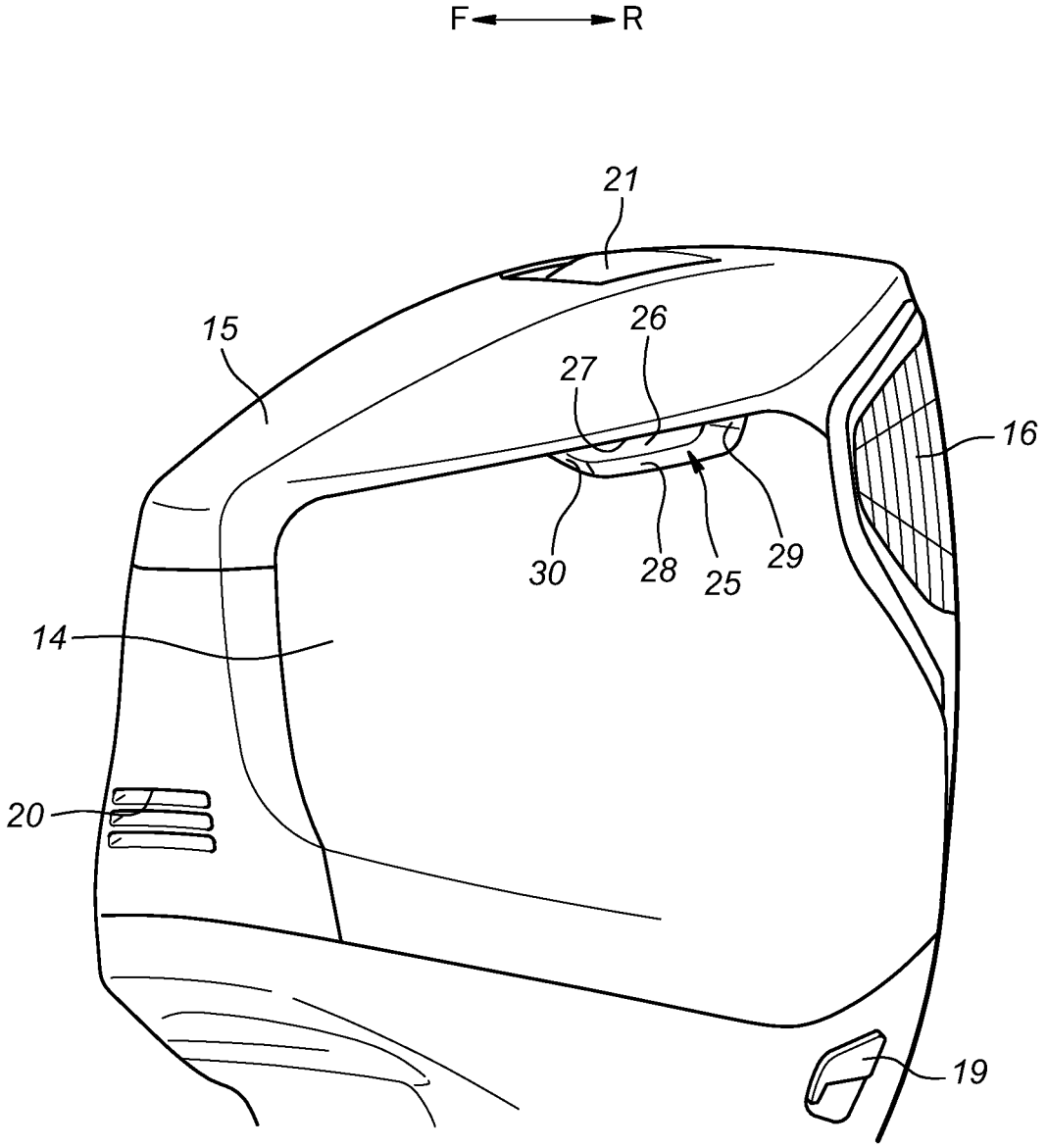
FIG. 4 is a side view of the upper case of the outboard motor.

Now the present invention is described in the following in more detail in terms of a concrete embodiment with reference to the appended drawings.

Referring to FIGS. 1 to 4, the outboard motor 1 according to an embodiment of the present invention is provided with a power source 2 consisting of an internal combustion engine which is supported by a main frame 3. The power source 2 may also consist of an electric motor. A drive shaft 4 extends vertically downward from the power source 2 in normal operation. The lower end of the drive shaft 4 is connected to a bevel gear mechanism 5 which is supported by a lower frame 17, and the lower frame 17 is fixedly connected to the main frame 3. The bevel gear mechanism 5 transmits power from the drive shaft 4 to a propeller 18 which is rotatably supported by the lower frame 17 via a propeller shaft 7 thereof that extends horizontally in normal operation.

The main frame 3 is covered by a lower case 12 whose lower end is connected to the lower frame 17. The main frame 3 is provided with a clamp mechanism 6 which is positioned in front of the lower case 12 for attaching the outboard motor 1 to a transom of a boat or any other part of watercraft. On the upper end of the lower case 12 is placed an upper case 13 in a detachable manner. The upper case 13 is latched to the lower case 12 via a latch mechanism not shown in the drawings, and a pair of latch handles 19 in the form of latch levers are provided on either side of an upper rear end part of the lower case 12. By pushing down the rear end of either one of the latch handles 19, the latch mechanism can be unlatched so that the upper case 13 can be lifted away from the lower case 12.

The upper case 13 primarily consists of a pair of side parts 14 jointly forming a cylindrical shell defining open top and bottom ends, and a top part 15 (FIG. 5) attached to the open top end of the cylindrical shell formed by the side parts 14. An air inlet 20 is provided in a lower front end part of the upper case 13 for the ventilation of the interior of the upper case 13. A rear end part of the upper case 13 is fitted with an ornamental grille member 16 which extends to an upper part of the lower case 12. The grille member 16 is made of plastic material, and is provided with a pair of openings fitted with louvers on either upper side part thereof. These openings serve as inlets for the intake of the power source 2.

The upper case 13 is made of cast aluminum alloy, and formed by joining the top part 15 and the side parts 14 (which are individually cast) by welding or by using fasteners. Alternatively, the upper case 13 may be made of other metallic materials such as sheet metal or plastic material. For the convenience of gripping the upper case 13 when removing the upper case 13 from the lower case 12 or the main frame 3, the upper case 13 is provided with a top recess 21 and a pair of side recesses 26.

The top recess 21 is positioned on the top surface part of the upper case 13. In particular, the top recess 21 is positioned on a laterally central line (extending in the fore and aft direction) and at a substantially central point with respect to the fore and aft direction. In the illustrated embodiment, the top recess 21 is somewhat offset from the central point toward the rear.

Figure 5:
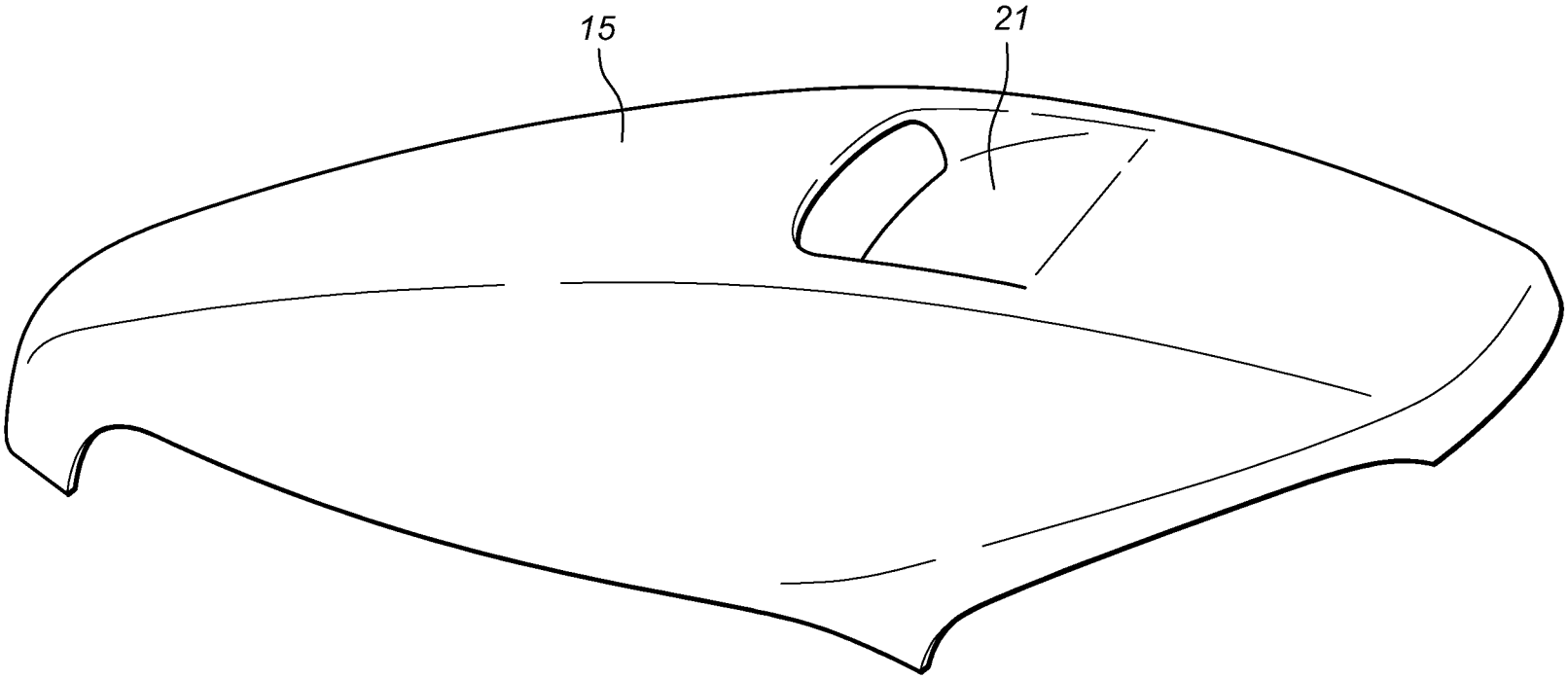
FIG. 5 is a perspective view of the top part of the upper case.
Figure 6:
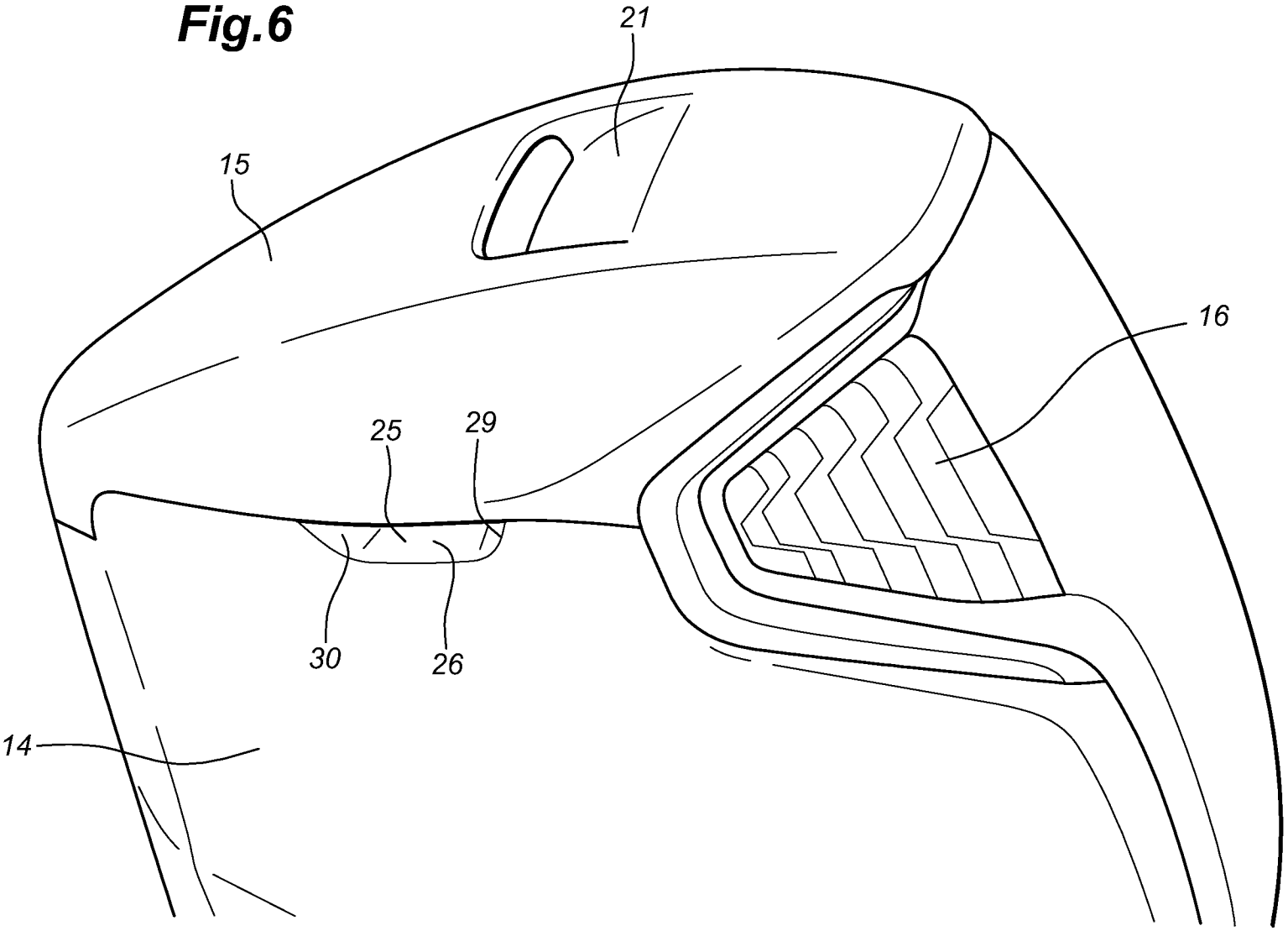
FIG. 6 is a perspective view of the upper case.
Figure 7:
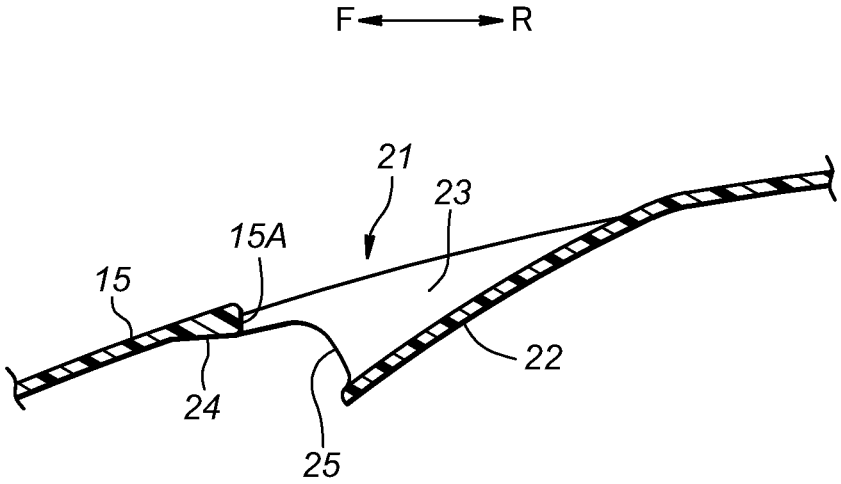
FIG. 7 is a fragmentary vertical sectional view of the top recess formed in the top part of the upper case.

The top recess 21 is formed by downwardly recessing a narrow strip of the top part 15 or the upper wall of the upper case 13. More specifically, as shown in FIGS. 5 to 7, the narrow strip is formed as a slanted wall 22 that has a certain lateral width substantially narrower than the lateral width of the upper case 13, and slants downward away from a general outer profile of the upper case toward a front part thereof. A pair of triangular side walls 23 extend between the respective side edges of the slanted wall 22 and the remaining part of the upper case 13. The side walls 23 extend substantially vertically in this embodiment, but may also be slanted outward toward the upper edges thereof.

As a result, a rectangular opening 25 is defined by the front edge of the slanted wall 22, the front edges of the side wall 23 and an edge (opposing edge 15A) of a part of the upper case 13 opposing the front edge of the slanted wall 22 from above. The downwardly facing wall surface 24 of the opposing edge 15A faces downward so that the user may conveniently grip the opposing edge 15A by applying the fingers of the user to the downwardly facing wall surface 24 from below. The opposing edge 15A may be positioned slightly forward of the front edge of the slanted wall 22, but may also vertically overlap with the front edge of the slanted wall 22 from above at their extremities. Alternatively, the opposing edge 15A may be positioned slightly rearward of the front edge of the slanted wall 22 so that the opposing edge 15A and the front edge of the slanted wall 22 vertically overlap with each other. Optionally, the opposing edge 15A may be reinforced by being given with an increased thickness.

Since the side recesses 26 are identical to each other (or mirror images of each other), only the side recess 26 on the left hand side of the outboard motor 1 will be described in the following.

The side recess 26 is shaped in an inverted trapezoidal shape, and is positioned adjacent to an upper edge of the corresponding side part 14 of the upper case 13. The side recess 26 is formed by inwardly recessing the wall of the upper case 13, in particular the side part 14 thereof.

Figure 8:
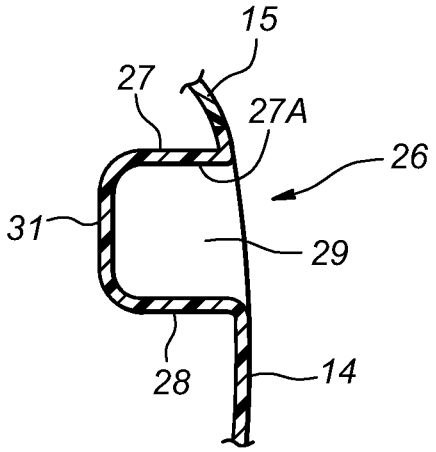
FIG. 8 is a fragmentary vertical sectional view of the side recess formed in the side part of the upper case.

As shown in FIG. 8, the side recess 26 is thus provided with a substantially horizontal upper wall 27, a lower wall 28 slightly slanted toward an outer end part thereof, and shorter in length than the upper wall along the fore and aft direction, a rear wall 29 extending between the rear edges of the upper wall 27 and the lower wall 28, a front wall 30 extending between the front edges of the upper wall 27 and the lower wall 28, and an inner wall 31 connected to the inner edges of the upper wall 27, a lower wall 28, the front wall 30 and the rear wall 29.

In this embodiment, the side recess 26 partly overlaps with the top recess 21 with respect to the fore and aft direction. In particular, a central point of the side recess 26 along the fore and aft direction overlaps with the top recess 21 with respect to the fore and aft direction.

The front wall 30 is slanted rearward toward a lower end part thereof, and the rear wall 29 is slanted forward toward a lower end part thereof. Therefore, the rear wall 29 and the front wall 30 each form an obtuse angle relative to the lower wall 28 in side view. The rear wall 29 and the front wall 30 may also come closer to each other toward the inner ends thereof so that the side recess 26 gets narrow toward the inner part thereof.

The mode of removing the upper case 13 from the main body of the outboard motor 1 will be discussed in the following. When the upper case 13 is desired to be removed, the rear end of either one of the latch handles 19 is depressed downward. If the outboard motor 1 is in the normal position (as opposed to the tilted-up position), the user then grabs the top recess 21, in particular the opposing edge 15A defining the upper edge of the rectangular opening 25 facing rearward with one hand, and one of the side recesses 26 with the other hand.

Since the both hands of the user are extended in a similar fashion when reaching for the upper recess 21 and the side recess 26 owing to the positioning of the top recess 21 and the side recess 26, a relatively little effort is required for the user to remove the upper case 13. Since the recesses 21, 26 are each provided with a downwardly facing wall surface 24, 27A, the user is enabled to put hands into the recesses 21, 26 and grab the downwardly facing wall surface 24, 27A in a comfortable manner.

Furthermore, the slanted wall 22 of the top recess 21 comfortably guides the user's hand which is about to grab the downwardly facing wall surface 24. Since each side recess 26 is configured to get narrow toward an inner part thereof, the user's hand which is about to grab the downwardly facing wall surface 27A is also guided in a comfortable manner. Since the side recess 26 is provided on each side of the upper case 13, the user is able to grab the upper case 13 in an effortless manner without regard if the user is left-handed or right-handed.

Figure 9:
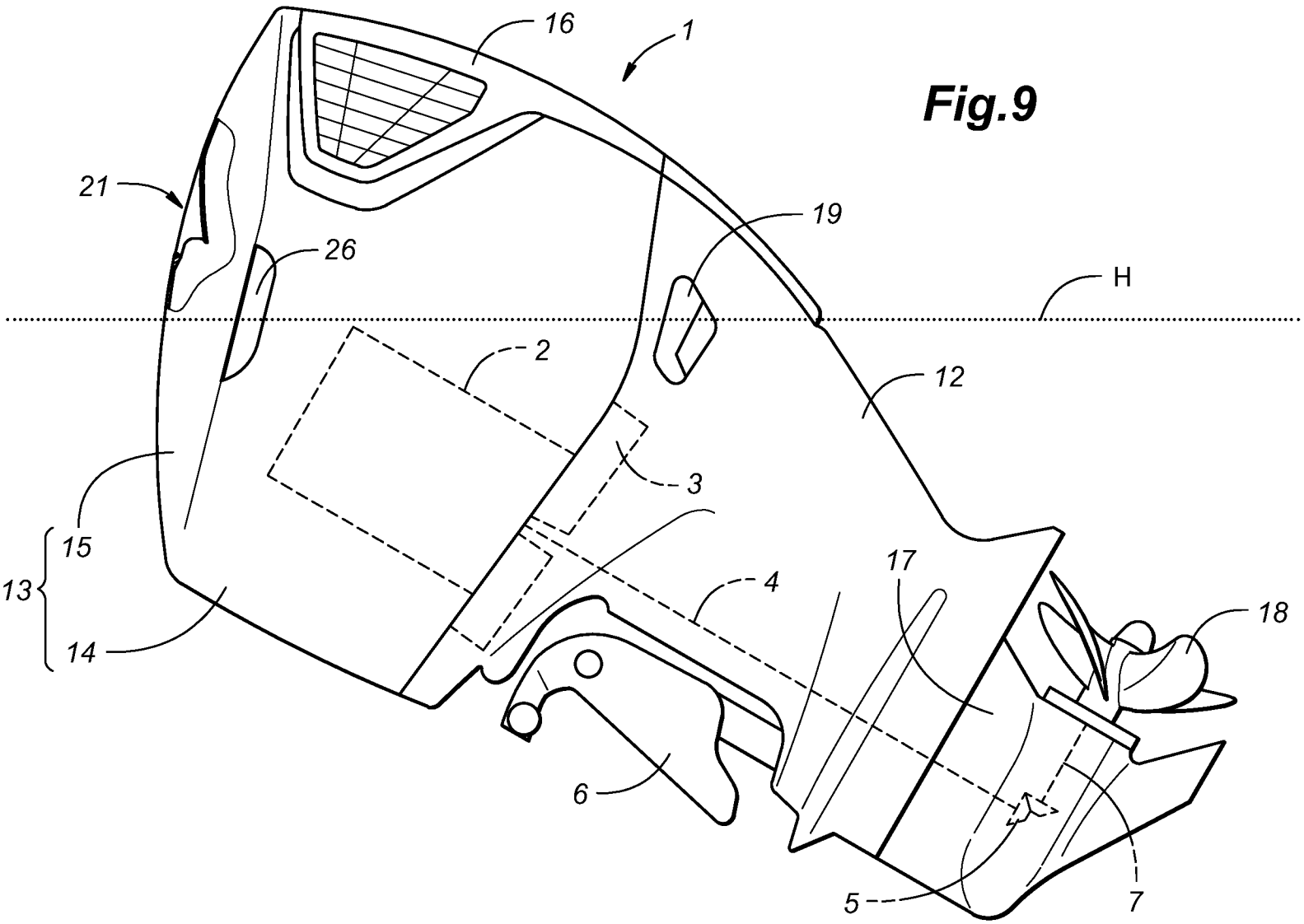
FIG. 9 is a side view of the outboard motor in a fully tilted-up state.

As shown in FIG. 9, when the outboard motor 1 is tilted rear end up (in the tilted-up position), the top recess 21 and the side recesses 26 are located substantially on a same horizontal line, and the top recess 21 faces the user. Furthermore, the side recesses 26 are positioned at some distance from the torso of the user while the top recess 21 is positioned near the user. Therefore, the user is again able to grab the upper case 13 in an effortless manner. In particular, the user can pull the upper case 13 toward the person of the user by grabbing the top recess 21, the user can keep the upper case 13 lifted in an effortless manner so that the upper case 13 can be removed without much effort.

Figure 10:
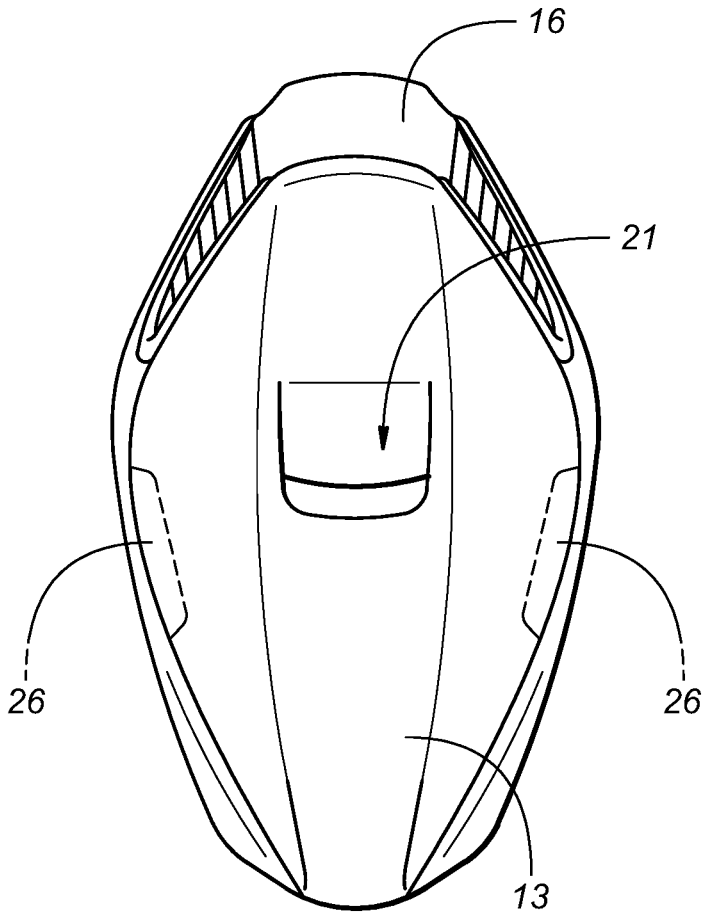
FIG. 10 is a view of the outboard motor in a steered and tilted-up sate as viewed from a user onboard the watercraft.

Moreover, as shown in FIG. 10, when the outboard motor 1 is tilted rear end up in a steered condition, one of the side recesses 26 is positioned on the underside of the outboard motor 1, and the top recess 21 faces the user. In this case also, the user is able to grab the upper recess 21 and pull the upper case 13 toward the user while supporting the upper case 13 from below via the side recess 26 so that the upper case 13 can be removed without much effort.

The top recess 21 is provided with the opening 25 that faces rearward, and the opposing edge 15A substantially vertically aligns with or overhangs the front edge of the slanted wall 22, so that rainwater and water splash are prevented from entering the upper case 13 via the opening 25. The opening 25 allows a favorable ventilation of air inside the upper case 13.

Since the lower wall 28 of each side recess 26 is slanted downward toward an outer part thereof, rainwater and water splash are prevented from being deposited in the side recess 26.

Although the present invention has been described in terms of a preferred embodiment thereof, it is obvious to a person skilled in the art that various alterations and modifications are possible without departing from the scope of the present invention which is set forth in the appended claims.

In addition, the specific configurations, arrangements, quantities, materials, etc. of various parts can be changed as appropriate within the scope of the present invention. Further, not all of the components shown in the above embodiment are essential, and can be selected and substituted as appropriate.

The invention claimed is:

1. An outboard motor, comprising:

a lower case having an open top end and covering a main frame that supports a power source and a drive shaft for transmitting a power output of the power source;

a bottom frame supporting a propeller, and a gear mechanism for transmitting the power output from a lower end of the drive shaft to the propeller; and an upper case attached to the open top end of the lower case in a detachable manner, wherein the upper case is provided with a top recess provided in a top surface part of the upper case, and a pair of side recesses provided on either side of the upper case, the top recess at least partly overlapping with the side recesses with respect to a fore and aft direction in normal operation, and wherein each side recess is substantially rectangular in side view, and is defined by an upper wall, a front wall, a rear wall and a lower wall, at least one of the front wall and the rear wall being at an angle to a vertical direction so that the upper wall is longer than the lower wall with respect to the fore and aft direction.

2. The outboard motor according to claim 1, wherein a central point of each side recess along the fore and aft direction overlaps with the top recess with respect to the fore and aft direction.

3. The outboard motor according to claim 1, wherein the recesses are positioned at a substantially middle part of the upper case with respect to the fore and aft direction.

4. The outboard motor according to claim 1, wherein each of the recesses is provided with a downwardly facing wall surface.

5. The outboard motor according to claim 1, wherein the front wall and the rear wall each form an obtuse angle relative to the lower wall in side view.

6. The outboard motor according to claim 1, wherein each side recess is configured to get narrower toward an inner part thereof.

7. The outboard motor according to claim 1, wherein the lower wall is slanted downward toward an outer part thereof.

8. The outboard motor according to claim 1, wherein each side recess is closed by an inner wall.

9. An outboard motor, comprising:

a lower case having an open top end and covering a main frame that supports a power source and a drive shaft for transmitting a power output of the power source;

a bottom frame supporting a propeller, and a gear mechanism for transmitting the power output from a lower end of the drive shaft to the propeller; and an upper case attached to the open top end of the lower case in a detachable manner, wherein the upper case is provided with a top recess provided in a top surface part of the upper case, and a pair of side recesses provided on either side of the upper case, the top recess at least partly overlapping with the side recesses with respect to a fore and aft direction in normal operation, and wherein the top recess is defined by a slanted wall that has a certain lateral width substantially smaller than an overall width of the upper case and slants downward away from a general outer profile of the upper case toward a front part thereof and a pair of triangular side walls extending vertically along either side edge of the slanted wall so as to define a rectangular opening facing rearward.

10. The outboard motor according to claim 9, wherein the rectangular opening communicates with an interior of the upper case.

11. An outboard motor, comprising:

a lower case having an open top end and covering a main frame that supports a power source and a drive shaft for transmitting a power output of the power source;

a bottom frame supporting a propeller, and a gear mechanism for transmitting the power output from a lower end of the drive shaft to the propeller; and an upper case attached to the open top end of the lower case in a detachable manner, wherein the upper case is provided with a top recess provided in a top surface part of the upper case, and a pair of side recesses provided on either side of the upper case, the top recess at least partly overlapping with the side recesses with respect to a fore and aft direction in normal operation, and wherein the upper case comprises a pair of side parts jointly forming a cylindrical shell defining open top and bottom ends, and a top part attached to the open top end of the cylindrical shell formed by the side parts, and the top recess is formed in the top part while the side recesses are formed in the side parts, respectively.

12. The outboard motor according to claim 1, wherein the side recesses are positioned adjacent to upper edges of side parts, respectively.

13. The outboard motor according to claim 1, wherein the lower case is provided with a latch handle for selectively latching the upper case to the lower case.

14. The outboard motor according to claim 1, wherein the outboard motor is configured to be selectively tilted up, and the top recess and the side recesses are positioned so as to overlap with each other with respect to the fore and aft direction.

15. The outboard motor according to claim 9, wherein the lower case is provided with a latch handle for selectively latching the upper case to the lower case.

16. The outboard motor according to claim 9, wherein the outboard motor is configured to be selectively tilted up, and the top recess and the side recesses are positioned so as to overlap with each other with respect to the fore and aft direction.

17. The outboard motor according to claim 11, wherein the side recesses are positioned adjacent to upper edges of the side parts, respectively.

18. The outboard motor according to claim 11, wherein the lower case is provided with a latch handle for selectively latching the upper case to the lower case.

19. The outboard motor according to claim 11, wherein the outboard motor is configured to be selectively tilted up, and the top recess and the side recesses are positioned so as to overlap with each other with respect to the fore and aft direction.

* * * * *